US005741118A

United States Patent [19]

Shinbara et al.

[11] Patent Number: 5,741,118

[45] Date of Patent: Apr. 21, 1998

[54] MULTIBLADE RADIAL FAN AND METHOD FOR MAKING SAME

[75] Inventors: Noboru Shinbara; Makoto Hatakeyama, both of Kitakyushu, Japan

[73] Assignee: Toto Ltd., Fukuoka-ken, Japan

[21] Appl. No.: 578,513

[22] PCT Filed: Apr. 21, 1995

[86] PCT No.: PCT/JP95/00789

§ 371 Date: Dec. 27, 1995

§ 102(e) Date: Dec. 27, 1995

[87] PCT Pub. No.: WO95/30093

PCT Pub. Date: Nov. 9, 1995

[30] Foreign Application Priority Data

Apr. 28, 1994 [JP] Japan ..... 6-111747

[51] Int. Cl.[6] ..... B63H 1/16

[52] U.S. Cl. ..... 416/186 R; 416/185; 416/223 B

[58] Field of Search ..... 416/185, 186 R, 416/223 B, 238, DIG. 2, 187

[56] References Cited

U.S. PATENT DOCUMENTS 3,734,640 5/1973 Daniel ..... 416/186 R 3,864,055 2/1975 Kletschka et al. ..... 416/186 R 4,022,423 5/1977 O'Connor et al. ..... 415/203

FOREIGN PATENT DOCUMENTS

A 56-6097 1/1981 Japan .

A 56-92397 7/1981 Japan .

A 63-285295 11/1988 Japan .

A 2-33494 2/1990 Japan .

A 3-88998 4/1991 Japan .

A 4-164196 6/1992 Japan .

*Primary Examiner*—Thomas E. Denion

*Attorney, Agent, or Firm*—Griffin, Butler, Whisenhunt & Kurtossy

[57] ABSTRACT

Noise is minimized in the design of multiblade radial fans, wherein the specifications of the impeller of a multiblade radial fan are determined so as to satisfy the correlation expressed by the formula $\nu \geqq -0.857Z_1+1.009$ (in the preceding formula, $\nu=r_0/r_1$, $Z_1=(r_1-r_0)/[r_1-nt/(2\pi)]$, where $r_0$ is the inside radius of the impeller, $r_1$ is the outside radius of the impeller, n is the number of radially-directed blades, and t is the thickness of the radially-directed blades).

12 Claims, 9 Drawing Sheets

△ : diameter ratio 0.40 ● : diameter ratio 0.58

○ : diameter ratio 0.75 □ : diameter ratio 0.90

MULTIBLADE RADIAL FAN AND METHOD FOR MAKING SAME

TECHNICAL FIELD

The present invention relates to a multiblade radial fan and a method for designing and making the same.

BACKGROUND ART

The radial fan, one type of centrifugal fan, has both its blades and interblade channels directed radially and is thus simpler than other types of centrifugal fans such as the sirocco fan, which has forwardly-curved blades, and the turbo fan, which has backwardly-curved blades. The radial fan is expected to come into wide use as a component of various kinds of household appliances.

However, design criteria for enhancing the quietness of the radial fan have not yet been established. This is because the radial fan has been applied mainly for handling corrosive gases, gases including fine particles and the like, taking advantage of the fact that radial fans having only a few blades enable easy repair and cleaning of the interblade channels. Fans used for this purpose do not have to be especially quiet.

A number of design criteria have been proposed for enhancing the quietness of centrifugal fans. For example, Japanese Patent Laid-Open Publication Sho 56-6097, Japanese Patent Laid-Open Publication Sho 56-92397, etc., propose elongating the interblade channels to prevent the air flow in the interblade channels from separating, flowing backward, etc. Japanese Patent Laid-Open Publication Sho 63-285295, Japanese Patent Laid-Open Publication Hei 2-33494, Japanese Patent Laid-Open Publication Hei 4-164196, etc., propose optimizing the number of blades of a sirocco fan with a large diameter ratio.

Japanese Patent Laid-Open Publication Sho 56-6097, Japanese Patent Laid-Open Publication Sho 56-92397, etc., disclose only the concept that the interblade channels should be elongated. They do not disclose any correlation which should be established among various fan specifications for optimizing the quietness of the fan. Thus, the proposals set out in Japanese Patent Laid-Open Publication Sho 56-6097, Japanese Patent Laid-Open Publication Sho 56-92397, etc., are not practical design criteria for obtaining a quiet fan.

The proposals of Japanese Patent Laid-Open Publication Sho 63-285295, Japanese Patent Laid-Open Publication Hei 2-33494, Japanese Patent Laid-Open Publication Hei 4-164196, etc., can be applied only to sirocco fans with large diameter ratios. Thus, these proposals are not general purpose design criteria for obtaining a quiet fan.

SUMMARY OF THE INVENTION

The inventors of the present invention have conducted an extensive study and found that there is a definite correlation between the quietness of a multiblade radial fan and the specifications of the impeller of the multiblade radial fan. The present invention was accomplished based on this finding.

The object of the present invention is therefore to provide methods for systematically determining the specifications of the impeller of a multiblade radial fan under a given condition, based on the above-mentioned definite correlation, and optimizing the quietness of the multiblade radial fan. Another object of the present invention is to provide a multiblade radial fan designed based on the method of the present invention.

According to a first aspect of the present invention, there is provided a method for designing a multiblade radial fan, wherein specifications of the impeller of the multiblade radial fan are determined so as to satisfy the correlation expressed by the formula $\nu \geqq -0.857Z_1+1.009$ (in the preceding formula, $\nu=r_0/r_1$, and $Z_1=(r_1-r_0)/[r_1-nt/(2\pi)]$, where $r_0$ is the inside radius of the impeller, $r_1$ is the outside radius of the impeller, n is the number of radially-directed blades, and t is the thickness of the radially-directed blades).

According to the first aspect of the present invention, there is also provided a method for designing a multiblade radial fan, wherein specifications of the impeller of the multiblade radial fan are determined so as to satisfy the correlation expressed by the formulas $\nu \geqq -0.857Z_1+1.009$ and $0.8 \geqq \nu \geqq 0.4$ (in the preceding formulas, $\nu=r_0/r_1$, $Z_1=(r_1-r_0)/[r_1-nt/(2\pi)]$, where $r_0$ is the inside radius of the impeller, $r_1$ is the outside radius of the impeller, n is the number of radially-directed blades, and t is the thickness of the radially-directed blades).

According to the first aspect of the present invention, there is also provided a multiblade radial fan, wherein specifications of the impeller of the multiblade radial fan satisfy the correlation expressed by the formula $\nu \geqq -0.857Z_1+1.009$ (in the preceding formula, $\nu=r_0/r_1$, $Z_1=(r_1-r_0)/[r_1-nt/(2\pi)]$, where $r_0$ is the inside radius of the impeller, $r_1$ is the outside radius of the impeller, n is the number of radially-directed blades, t is the thickness of the radially directed blades).

According to the first aspect of the present invention, there is also provided a multiblade radial fan, wherein specifications of the impeller of the multiblade radial fan satisfy the correlation expressed by the formulas $\nu \geqq -0.857Z_1+1.009$ and $0.8 \geqq \nu \geqq 0.4$ (in the preceding formulas, $\nu=r_0/r_1$, $Z_1=(r_1-r_0)/[r_1-nt/(2\pi)]$, where $r_0$ is the inside radius of the impeller, $r_1$ is the outside radius of the impeller, n is the number of radially-directed blades, and t is the thickness of the radially-directed blades).

According to a second aspect of the present invention, there is provided a method for designing a multiblade radial fan, wherein specifications of the impeller of the multiblade radial fan are determined so as to satisfy the correlation expressed by the formula $(1.009-\nu)/(1-\nu) \leqq Z_2$ (in the preceding formula, $\nu=r_0/r_1$, $Z_2=0.857\{t_0/|(2\pi r_1/n)-t|+1\}$, where $r_0$ is the inside radius of the impeller, $r_1$ is the outside radius of the impeller, n is the number of radially-directed blades, t is the thickness of the radially-directed blades, and $t_0$ is the reference thickness=0.5 mm).

According to the second aspect of the present invention, there is also provided a method for designing a multiblade radial fan, wherein specifications of the impeller of the multiblade radial fan are determined so as to satisfy the correlation expressed by the formulas $(1.009-\nu)/(1-\nu) \leqq Z_2$ and $0.8 \geqq \nu \geqq 0.4$ (in the preceding formulas, $\nu=r_0/r_1$, $Z_2=0.857\{t_0/[(2\pi r_1/n)-t]+1\}$, where $r_0$ is the inside radius of the impeller, $r_1$ is the outside radius of the impeller, n is the number of radially-directed blades, t is the thickness of the radially-directed blades, and $t_0$ is the reference thickness=0.5 mm).

According to the second aspect of the present invention, there is also provided a multiblade radial fan, wherein specifications of the impeller of the multiblade radial fan satisfy the correlation expressed by the formula $(1.009-\nu)/(1-\nu) \leqq Z_2$ (in the preceding formula, $\nu=r_0/r_1$, $Z_2=0.857\{t_0/[(2\pi r_1/n)-t|+1\}$, where $r_0$ is the inside radius of the impeller, $r_1$ is the outside radius of the impeller, n is the number of radially-directed blades, t is the thickness of the radially-directed blades, $t_0$ is the reference thickness=0.5 mm).

According to the second aspect of the present invention, there is also provided a multiblade radial fan, wherein specifications of the impeller of the multiblade radial fan satisfy the correlation expressed by the formulas $(1.009-\nu)/(1-\nu)\leqq Z_2$ and $0.82\geqq\nu\geqq0.4$ (in the preceding formulas, $\nu=r_0/r_1$, and $Z_2=0.857\{t_0/|(2\pi r_1/n)-t|+1\}$, where $r_0$ is the inside radius of the impeller, $r_1$ is the outside radius of the impeller, n is the number of radially-directed blades, t is the thickness of the radially-directed blades, $t_0$ is the reference thickness=0.5 mm)).

According to another aspect of the present invention, there is provided a multiblade radial fan comprising an impeller having many radially-directed blades which are circumferentially spaced from each other so as to define narrow channels between them, wherein laminar boundary layers in the interblade channels are prevented from separating.

According to a preferred embodiment of the present invention, inner end portions of the radially-directed blades are bent in the direction of rotation of the impeller.

DETAILED DESCRIPTION OF THE PREFERRED EMBODIMENTS

Preferred embodiments of the present invention will be described below.

I. First Aspect of the Invention

A. Theoretical background

When air flows through radially-directed interblade channels of a rotating impeller, laminar boundary layers, which separate easily, develop on the suction surfaces of the blades of the impeller, and turbulent boundary layers, which do not separate easily, develop on the pressure surfaces of the blades of the impeller.

The separation of the laminar boundary layers causes secondary flows in the radially-directed interblade channels of the impeller. The secondary flows cause noise and a drop in the efficiency of the impeller.

Thus, for designing a quiet multiblade radial fan, it is important to prevent the separation of the laminar boundary layers which develops on the suction surfaces of the blades.

The following formulas I, II have been given for expressing the state of a laminar boundary layer in a static divergent channel by Karman and Millikan (Von Karman, T., and Millikan, C. B., "On the Theory of Laminar Boundary Layers involving Separation", NACA Rept. No. 504,1934).

$$U/Ui=1\ (0\leqq X/Xe\leqq1) \qquad \text{I}$$

$$U/Ui=1+F(X-Xe)/Xe\ (1\leqq X/Xe) \qquad \text{II}$$

Figure 1:
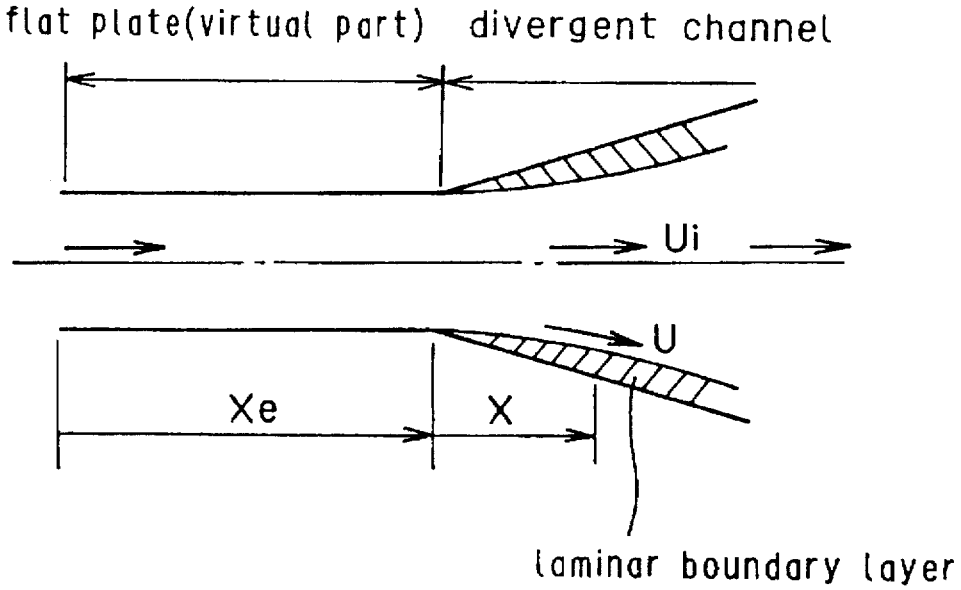
FIG. 1 is a plan view of a divergent channel showing the state of a laminar flow in the divergent channel.

In the above formulas, as shown in FIG. 1,

X is the distance from the fore end of a flat plate (virtual part),

Xe is the length of a flat plate (virtual part),

U is the flow velocity outside of a laminar boundary layer at point X,

Ui is the maximum flow velocity at point X, and

F is defined as: F=(Xe/Ui)(dU/dX).

In the above formulas, the second term of the right side of the formula II is a nondimensional term which expresses the state of the laminar boundary layer in the divergent channel. Thus, the second term of the right side of the formula II can be effectively used for designing a quiet multiblade radial fan.

If the second term of the right side of the formula II is expressed as Z, and X–Xe is expressed as x (x=X–Xe), the nondimensional term Z is obtained as $$Z=(x/Ui)\ (dU/dx) \qquad \text{III}$$

it is fairly hard to obtain analytically or experimentally the flow velocity U outside of the laminar boundary layer at point X and the maximum flow velocity Ui at point X. Thus, the flow velocity U outside of the laminar boundary layer at point X is replaced with the mean velocity $U_m$ at point X, and the maximum flow velocity Ui at point X is replaced with the mean velocity $U_0$ at the inlet of the divergent channel. Thus, the formula III is rewritten as $$Z=(x/U_0)\ (dUm/dx) \qquad \text{IV}$$

The nondimensional term Z defined by the formula IV expresses the state of the laminar boundary layer in a static divergent channel. So, the formula IV cannot be applied directly to a laminar boundary layer in a rotating divergent channel.

Rotation of a divergent channel causes a pressure gradient in the circumferential direction between the suction surface of a blade and the pressure surface of the adjacent blade. However, the circumferential pressure gradient between the suction surface of the blade and the pressure surface of the adjacent blade is small in an interblade channel of the impeller of a multiblade radial fan, wherein the ratio between chord length and pitch (distance between the adjacent blades) is large. That is, in the multiblade radial fan, wherein the ratio between chord length and pitch is large, the effect of the rotation on the state of the air flow in the interblade divergent channel is small. Thus, the nondimensional term Z defined by the formula IV accurately approximates the state of the laminar boundary layer in the interblade divergent channel of a rotating multiblade radial fan and can be effectively used for designing a quiet multiblade radial fan.

The absolute value of the nondimensional term Z, defined by the formula IV, at the outer end or the outlet of the interblade divergent channel of the multiblade radial fan is defined as $Z_1$. The term $Z_1$ is expressed by the following formula V. Hereinafter, the term $Z_1$ is called Karman-Millikan's first nondimensional number.

$$Z_1=(r_1-r_0)/[r_1-nt/(2\pi)] \quad \text{V}$$

Figure 2:
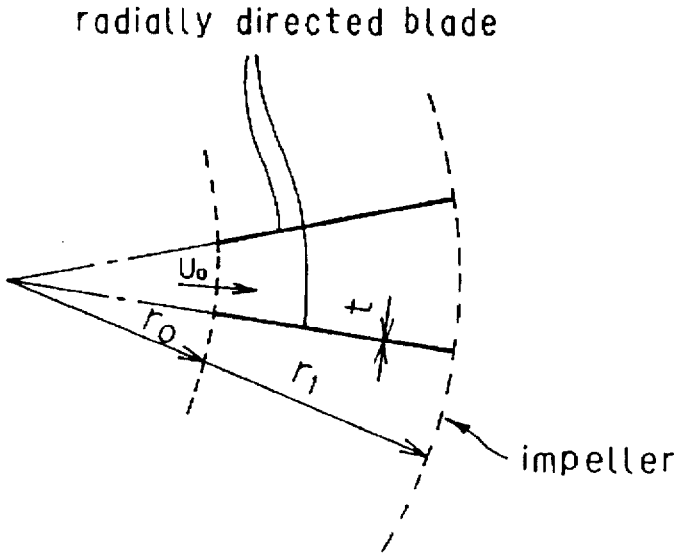
FIG. 2 is a plan view of divergent channels between radially-directed blades of the impeller of a multiblade radial fan.

In the formula V, as shown in FIG. 2, $r_0$ is the inside radius of the impeller, $r_1$ is the outside radius of the impeller, n is the number of radially-directed blades, and t is the thickness of the radially-directed blades B. Performance Test of Multiblade Radial Fan.

Performance tests were carried out on multiblade radial fans with different values of the term $Z_1$.

Figure 3:
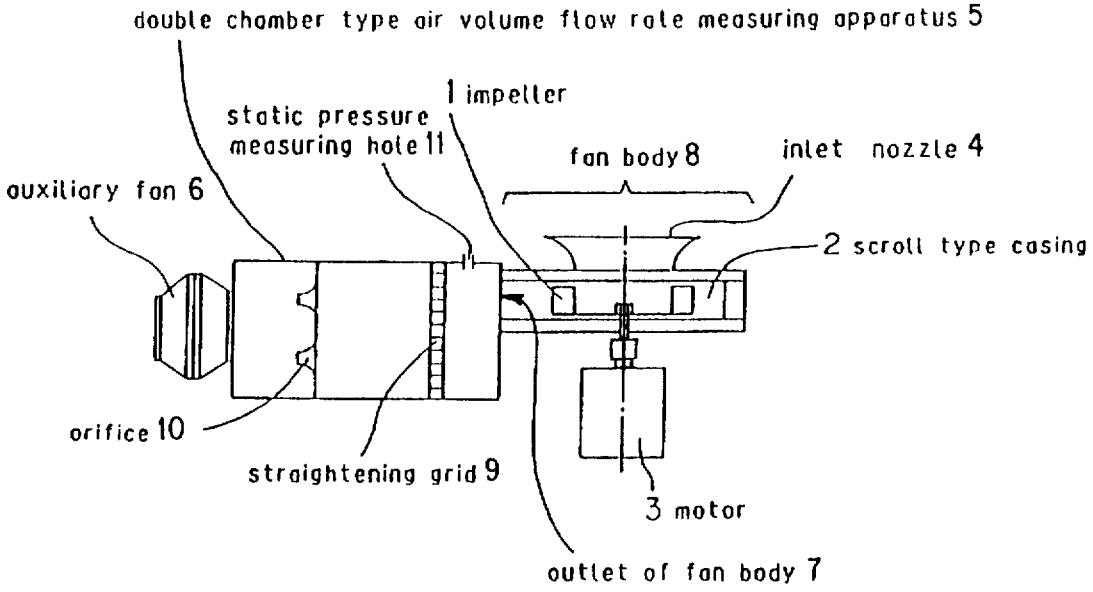
FIG. 3 is an arrangement plan of a measuring apparatus for measuring air volume flow rate and static pressure of a multiblade radial fan.

1. Test Conditions (a) Measuring apparatuses (i) Measuring apparatus for measuring air volume flow rate and static pressure The measuring apparatus used for measuring air volume flow rate and static pressure is shown in FIG. 3. The fan body had an impeller 1, a scroll type casing 2 for accommodating the impeller 1 and a motor 3. An inlet nozzle 4 was disposed on the suction side of the fan body. A double chamber type air volume flow rate measuring apparatus 5 (product of Rika Seiki Co. Ltd., Type F-401) was disposed on the discharge side of the fan body. The air volume flow rate measuring apparatus was provided with an air volume flow rate control damper (not shown) and an auxiliary fan 6 for controlling the static pressure at the outlet 7 of the fan body 8. The air flow discharged from the fan body was straightened by a straightening grid 9.

The air volume flow rate of the fan body was measured using orifices 10 located in accordance with the AMCA standard.

The static pressure at the outlet of the fan body was measured through a static pressure measuring hole 11 disposed near the outlet of the fan body.

(ii) Measuring apparatus for measuring sound pressure level.

Figure 4:
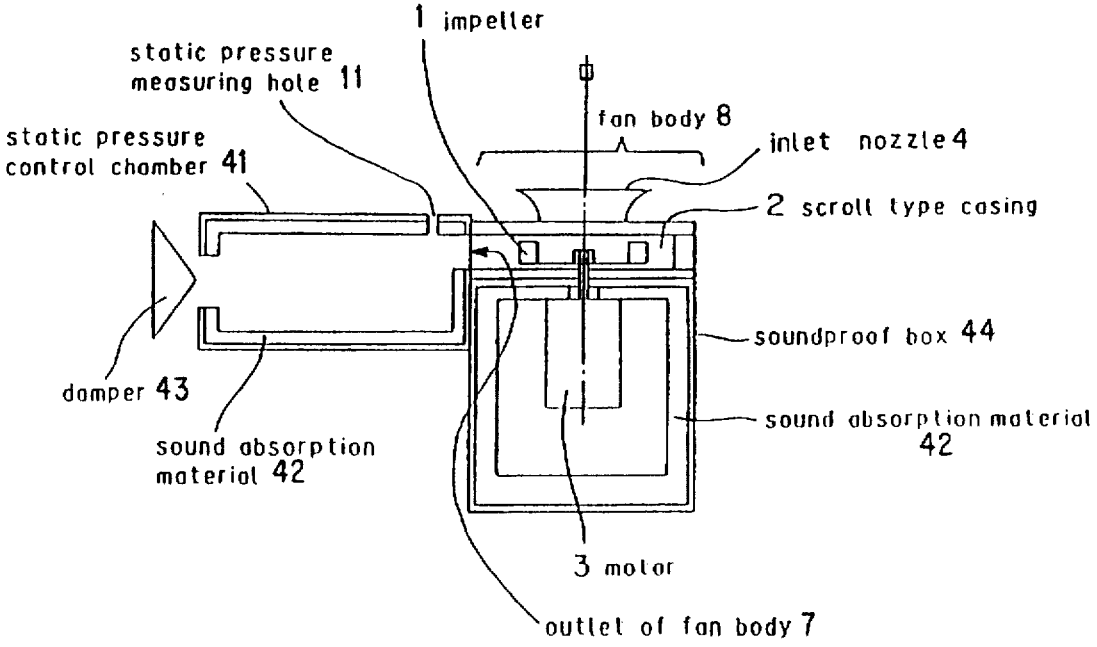
FIG. 4 is an arrangement plan of a measuring apparatus for measuring the sound pressure level of a multiblade radial fan.

The measuring apparatus for measuring sound pressure level is shown in FIG. 4. An inlet nozzle 40 was disposed on the suction side of the fan body. A static pressure control chamber 41 of a size and shape similar to those of the air volume flow rate measuring apparatus 5 was disposed on the discharge side of the fan body. The inside surface of the static pressure control chamber 41 was covered with sound absorption material 42. The static pressure control chamber 41 was provided with an air volume flow rate control damper 43 for controlling the static pressure at the outlet 7 of the fan body.

The static pressure at the outlet 7 of the fan body was measured through a static pressure measuring hole 11 located near the outlet of the fan body. The sound pressure level corresponding to a certain level of the static pressure at the outlet 7 of the fan body 8 was measured.

The motor 3 was installed in a soundproof box 44 lined with sound absorption material 42. Thus, the noise generated by the motor 3 was confined.

The measurement of the sound pressure level was carried out in an anechoic room. A-weighted sound pressure level was measured at a point on the centerline of the impeller and 1 m above the upper surface of the casing.

(b) Tested impellers, Tested Casing (i) Tested impellers

Figure 5A:
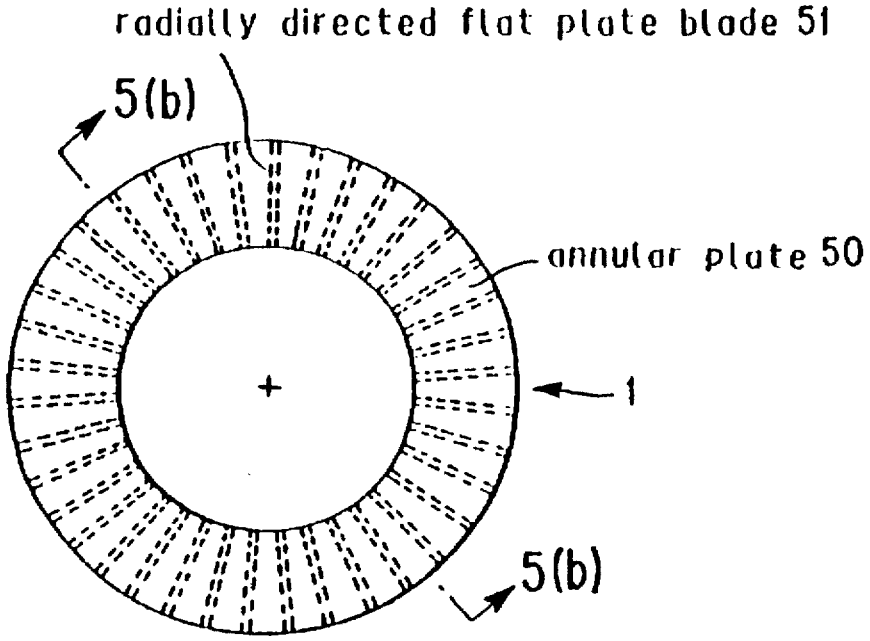
FIG. 5(*a*) is a plan view of a tested impeller and FIG. 5(*b*) is a sectional view taken along line b—b in FIG. 5(*a*).
Figure 5B:
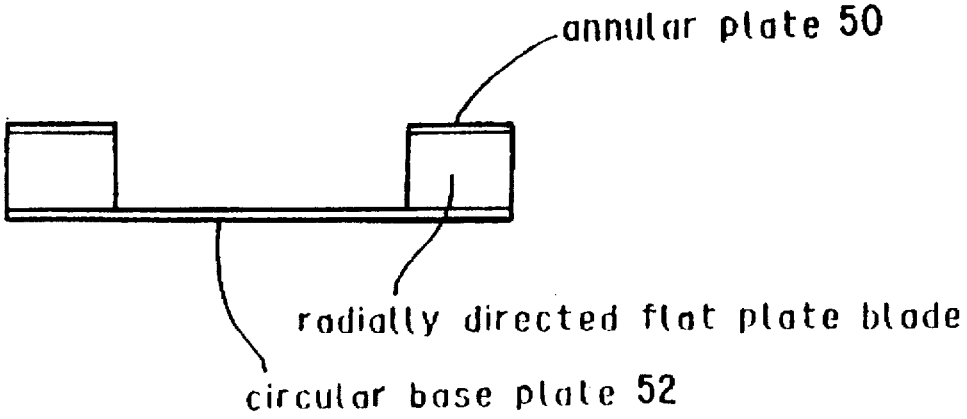

As shown in FIGS. 5(a) and 5(b), the outside diameter and the height of all tested impellers were 100 mm and 24 mm respectively. The thickness of the circular base plate and the annular top plate 50 of all tested impellers was 2 mm. Impellers with four different inside diameters were made. Different impellers had a different number of radially-directed flat plate blades 51 disposed at equal circumferential distances from each other. A total of 21 kinds of impellers 1 were made and tested. The particulars and Karman-Millikan's first nondimensional number $Z_1$ of the tested impellers 1 are shown in Table 1, and FIGS. 5(a) and 5(b).

(ii) Tested casing

As shown in FIG. 3, the height of the scroll type casing 2 was 27 mm. The divergence configuration of the scroll type casing 2 was logarithmic spiral defined by the following formula. The divergence angle $\theta_c$ was 4.50°.

$$r=r_2[\exp(\theta \tan \theta_c)]$$

In the above formula, r is the radius of the side wall of the casing measured from the center of the impeller 1, $r_2$ is the outside radius of the impeller 1, $\theta$ is the angle measured from a base line, $0 \leqq \theta \leqq 2\pi$, and $\theta_c$ is the divergence angle.

Figure 6:
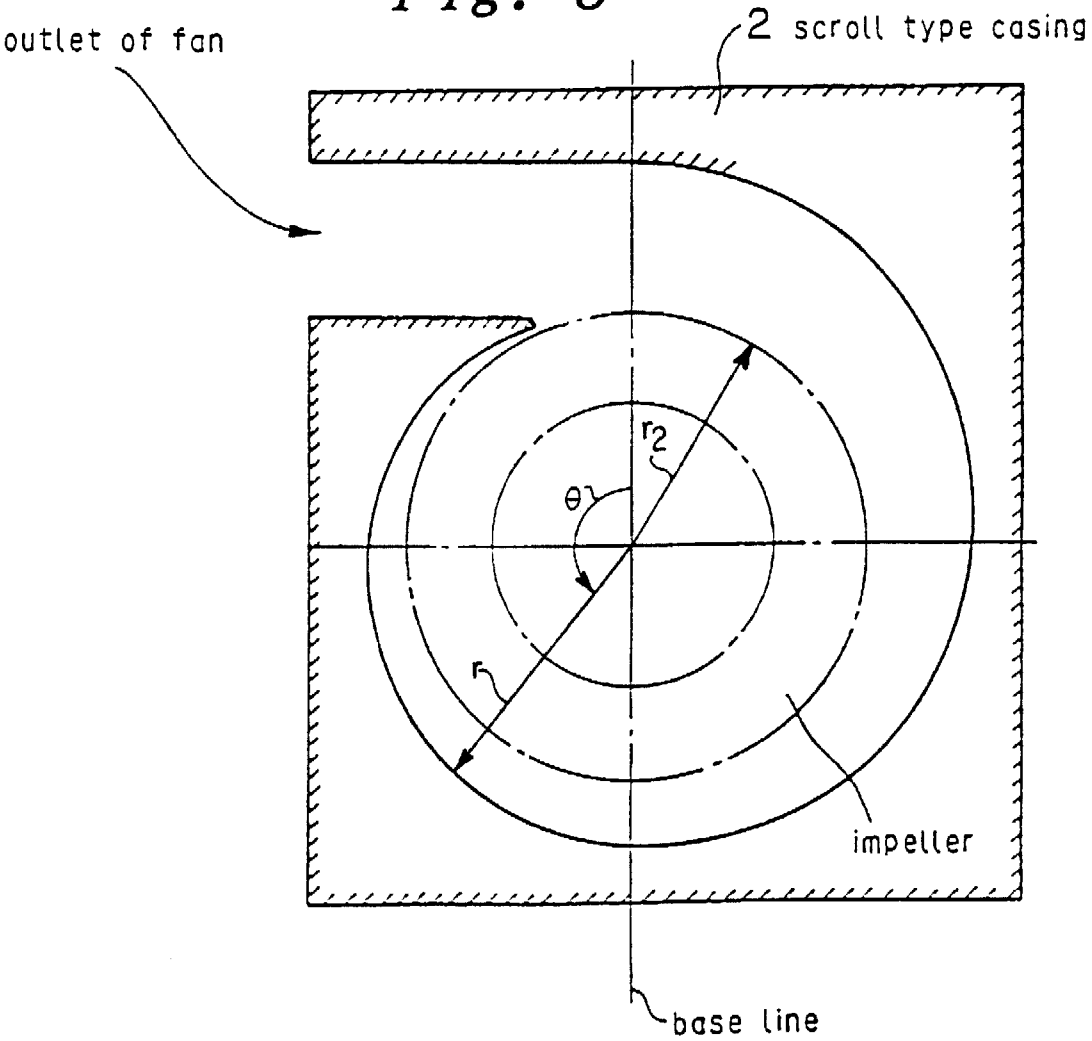
FIG. 6 is a plan view of a tested casing.

The tested casing 2 is shown in FIG. 6.

(iii) Revolution speed of the impeller 1

The revolution speed of the impeller 1 was generally fixed at 6000 rpm but was varied to a certain extent considering extrinsic factors such as background noise in the anechoic room, condition of the measuring apparatus, etc. The revolution speeds of the impeller 1 during measurement are shown in Table 1.

2. Measurement, Data Processing (a) Measurement

The air volume flow rate of the air discharged from the fan body, the static pressure at the outlet 7 of the fan body 8, and the sound pressure level were measured for each of the 21 kinds of the impellers 1 shown in Table 1 when rotated at the revolution speed shown in Table 1, while the air volume flow rate of the air discharged from the fan body 8 was varied using the air volume flow rate control dampers 43.

(b) Data Processing

From the measured value of the air volume flow rate of the air discharged from the fan body 8, the static pressure at the outlet 7 of the fan body 8, and the sound pressure level, a specific sound level $K_s$ defined by the following formula was obtained.

$$K_s=SPL(A)-10\log_{10}Q(Pt)^2$$

In the above formula,

SPL(A) is the A-weighted sound pressure level, in units of dB,

Q is the air volume flow rate of the air discharged from the fan body, in units of $m^3/s$, and $P_t$ is the total pressure at the outlet of the fan body, in units of mmAq.

(c) Test Results

Based on the results of the measurements, a correlation between the specific sound level $K_s$ and the air volume flow rate was obtained for each tested impeller 1.

The correlation between the specific sound level $K_s$ and the air volume flow rate Q was obtained on the assumption that a correlation (wherein the specific sound level $K_s$ is $K_{s1}$ when the air volume flow rate Q is $Q_1$) exists between the specific sound level $K_s$ and the air volume flow rate Q when the air volume flow rate Q and the static pressure p at the outlet of the fan body obtained by the air volume flow rate and static pressure measurement are $Q_1$ and $p_1$ respectively, while the specific sound level $K_s$ and the static pressure p at the outlet of the fan body obtained by the sound pressure level measurement are $K_{s1}$ and $p_1$ respectively. The above assumption is thought to be reasonable as the size and the shape of the air volume flow rate measuring apparatus used in the air volume flow rate and static pressure measurement are substantially the same as those of the static pressure controlling chamber 41 used in the sound pressure level measurement (FIG. 4).

The measurement showed that the specific sound level $K_s$ of each tested impeller 1 varied with variation in the air volume flow rate. The variation of the specific sound level $K_s$ is generated by the effect of the casing 2. Thus, it can be assumed that the minimum value of the specific sound level $K_s$ or the minimum specific sound level $K_{smin}$ represents the noise characteristic of the tested impeller 1 itself free from the effect of the casing 2.

Figure 7:
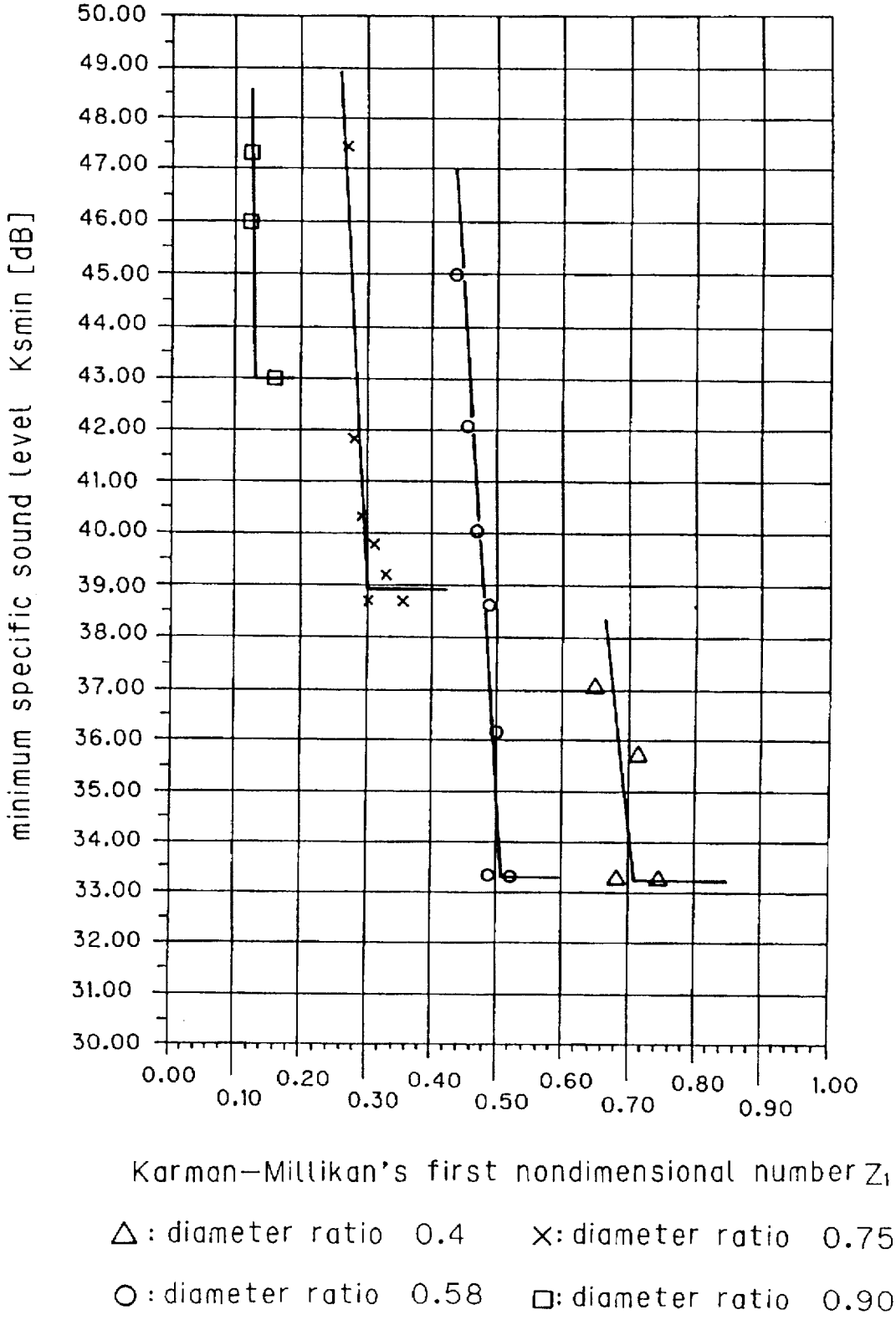
FIG. 7 shows experimentally-obtained correlation diagrams between minimum specific sound level $K_{smin}$ and first Karman-Millikan nondimensional number $Z_1$ of tested impellers.

The minimum specific sound levels $K_{smin}$ of the tested impellers 1 are shown in Table 1. Correlations between the minimum specific sound levels $K_{smin}$ and Karman-Millikan's first nondimensional number $Z_1$ of the tested impellers 1 are shown in FIG. 7. FIG. 7 also shows correlation diagrams between the minimum specific sound level $K_{smin}$ and Karman-Millikan's first nondimensional number $Z_1$ of each group of the impellers 1 having the same diameter ratio.

As is clear from FIG. 7, for the same diameter ratio of the impeller 1, the minimum specific sound level $K_{smin}$ decreased as Karman-Millikan's first nondimensional number $Z_1$ increased. It is also clear from the correlation diagrams shown in FIG. 7 that in the groups of the impellers 1 with diameter ratios of 0.75, 0.58 and 0.4, the minimum specific sound level $K_{smin}$ stayed at a constant minimum value when Karman-Millikan's first nondimensional number $Z_1$ became larger than a certain threshold value. The reason why the minimum specific sound level $K_{smin}$ stays at a constant minimum value when Karman-Millikan's first nondimensional number $Z_1$ becomes larger than a certain threshold value is thought to be that the increase in the number of the blades causes the interblade channels to become more slender, thereby suppressing the separations of the laminar boundary layers in the interblade channels. An analysis using differential calculus was carried out on the air flow in the interblade channel of an impeller 1 with a diameter ratio of 0.58. From the analysis, it was confirmed that a separation does not occur in the laminar boundary layer at the measuring point on the horizontal part of the correlation diagram in FIG. 7 where $Z_1$ is 0.5192, while a separation occurs in the laminar boundary layer at the measuring point on the inclined part of the correlation diagram in FIG. 7 where $Z_1$ is 0.4813.

As to the group of the impellers 1 with diameter ratios of 0.90, the threshold value of $Z_1$ is not clear because the number of the measured points was small. In FIG. 7, the correlation diagram of the group of the impellers 1 with diameter ratios of 0.90 is assigned a threshold value of $Z_1$ estimated from the threshold values of $Z_1$ of the correlation diagrams of other groups of the impellers 1.

Figure 8:
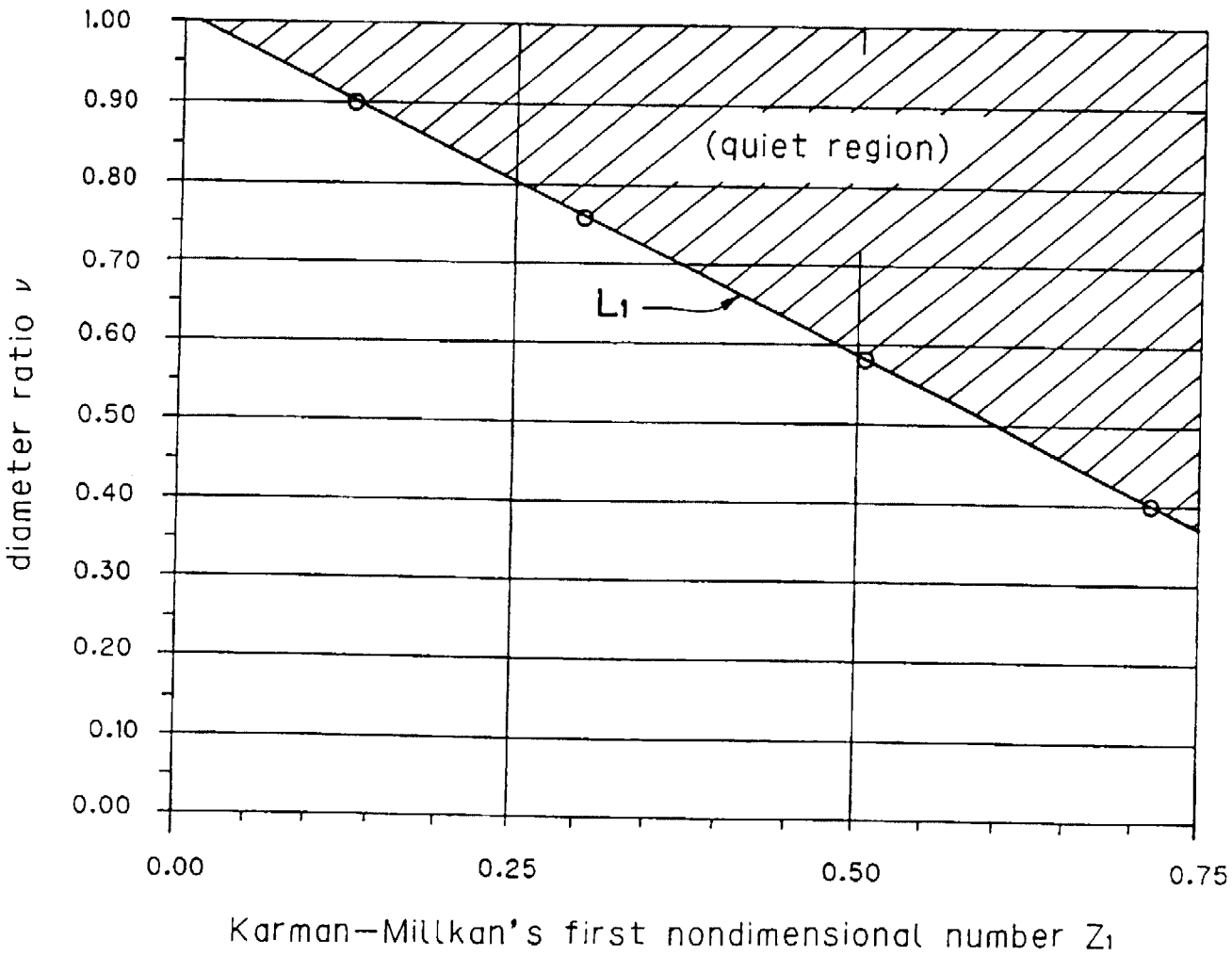
FIG. 8 is a correlation diagram between diameter ratio and threshold level of first Karman-Millikan nondimensional number $Z_1$ of test-impellers.

Correlations between the diameter ratio ν of the impeller 1 and the threshold value of Karman-Millikan's first nondimensional number $Z_1$ were obtained the correlation diagrams between the minimum specific sound level $K_{smin}$ and Karman-Millikan's first nondimensional number $Z_1$ of the groups of the impellers 1 with diameter ratios of 0.75, 0.58 and 0.4. The correlations are shown in FIG. 8. From FIG. 8, there was obtained a correlation diagram $L_1$ between the diameter ratio ν of the impeller 1 and the threshold value of Karman-Millikan's first nondimensional number $Z_1$. The correlation diagram $L_1$ is defined by the following formula VI.

$$\nu=-0.857Z_1+1.009 \qquad \text{VI}$$

In the above formula, $\nu=r_0/r_1$, and $Z_1=(r_1-r_0)/[r_1-nt/(2\pi)]$.

The correlation diagram $L_1$ can be applied to impellers with diameter ratio ranging from 0.40 to 0.75. As is clear from FIG. 8, the correlation diagram $L_1$ is straight.

Therefore, there should be practically no problem in applying the correlation diagram $L_1$ to impellers with diameter ratio ν ranging from 0.30 to 0.90.

As shown in FIG. 8, the hatched area to the right of the correlation diagram $L_1$ is the quiet region wherein the minimum specific sound level $K_{smin}$ of an impeller 1 of diameter ratio ν stays at a constant minimum value. Thus, the quietness of a multiblade radial fan can be optimized systematically, without resorting to trial and error, by determining the specifications of the impeller of diameter ratio ν so that Karman-Millikan's first nondimensional number $Z_1$ falls in the hatched region in FIG. 8, or satisfies the correlation defined by below formula VII.

$$\nu \geqq -0.857Z_1+1.009 \qquad \text{VII}$$

In the above formula, $\nu=r_0/r_1$, and $Z_1=(r_1-r_0)/[r_1-nt/(2\pi)]$, wherein $r_0$ is the inside radius of the impeller, $r_1$ is the outside radius of the impeller, n is the number of the radially-directed blades, and t is the thickness of the radially-directed blades.

FIG. 8 also shows the correlation between the diameter ratio ν of an impeller 1 with a diameter ratio of 0.90 and the threshold value of Karman-Millikan's first nondimensional number $Z_1$ which is obtained from the correlation diagram shown in FIG. 7. As is clear from FIG. 8, the correlation between the diameter ratio ν of the impeller 1 with a diameter ratio of 0.90 and the threshold value of the Karman-Millikan's first nondimensional number $Z_1$ falls on the correlation diagram $L_1$.

As will be understood from the above description, the quietness of a multiblade radial fan whose diameter ratio is in the range of from 0.30 to 0.90 can be optimized based on the formula VII. However, as shown in FIG. 7, the minimum value of the minimum specific sound level $K_{smin}$ of an impeller with a diameter ratio ν of 0.90 is about 43 dB.

In other words, an impeller with a diameter ratio ν of 0.90 cannot be made sufficiently quiet. On the other hand, an impeller with a diameter ratio ν of 0.30 cannot easily be equipped with many radial blades because of the small inside radius. It is therefore appropriate to apply the formula VII to impellers with diameter ratios ν in the range of from 0.40 to 0.80. Thus, a multiblade radial fan that achieves optimum and sufficient quietness under a given condition and is easy to fabricate can be designed systematically, without resorting to trial and error, by applying the formula VII to an impeller whose diameter ratio ν falls in the range of from 0.40 to 0.80.

As is clear from the formula V, Karman-Millikan's first nondimensional number $Z_1$ includes the term "n" (number of the radially-directed blades) and the term "t" (thickness of the radially-directed blade) in the form of the product "nt". Thus, the term "n" and the term "t" cannot independently contribute to the optimization of the quietness of the multiblade radial fan. Thus, in accordance with the first aspect of the invention, the quietness of a multiblade radial fan wherein n=100, t=0.5 mm should be equal to that of a multiblade radial fan wherein n=250, t=0.2 mm because the products "nt" are equal, making Karman-Millikan's first nondimensional number $Z_1$ of the former fan equal to that of the latter. In fact, however, there is some difference in the quietness between the two because of the difference in the shape of the interblade channels between the two. Therefore, the quietness of a multiblade radial fan should preferably be optimized in accordance with the first aspect of the invention by:

(1) determining the design value $Z_{1s}$ of Karman-Millikan's first nondimensional number $Z_1$ which optimizes the quietness of the multiblade radial fan in accordance with the formula VII, and (2) selecting the best combination of "n" and "t" from the plurality of combinations of "n" and "t" which achieve the design value $Z_{1s}$ based on a sound pressure level measurement.

II. Second Aspect of the Invention

A. Theoretical background

As explained above, the first aspect of the invention has a shortcoming in that the term "n" and the term "t" cannot independently contribute to the optimization of the quietness of a multiblade radial fan.

This problem can be overcome by optimizing the quietness of the multiblade radial fan based on a nondimensional number which includes the terms "n" and "t" independently.

To this end, the formula VII is rewritten by replacing the constant values −0.857 and 1.009 with "a" and "b" respectively and then converting it to $$r_0/r_1 \geqq a(r_1-r_0)/[r_1-nt/(2\pi)]+b \qquad \text{VIII}$$

A formula IX is derived from the formula VIII.

$$2\pi r_1-nt \leqq -a(2\pi r_1)[(1-r_0/r_1)/(b-r_0/r_1)] \qquad \text{IX}$$

A formula X is derived from the formula IX.

$$(2\pi r_1/n)-t \leqq a(2\pi r_1)[(1-r_0/r_1)/(b-r_0/r_1)]/n \qquad \text{X}$$

The term $(2\pi r_1/n)-t$ making up the left side of the formula X is the outlet breadth Δl of the interblade divergent channel. Thus, the first aspect of the invention indicates that the quietness of a multiblade radial fan is optimized when the outlet breadth Δl of the interblade divergent channel satisfies the formula X.

When the left side is equal to the right side in the formula X, the number $n_c$ of the radially-directed blades and the outlet breadth $\Delta l_c$ of the interblade divergent channel are expressed as follows.

$$n_c=(2\pi r_1/t)[1+a(1-r_0/r_1)/(b-r_0/r_1)]$$

$$\begin{aligned}\Delta l_c &= (2\pi r_1/n_c)-t \\ &= a[(1-r_0/r_1)/(b-r_0/r_1)]t/[1+a(1-r_0/r_1)/(b-r_0/r_1)] \\ &= -at/[(b-r_0/r_1)/(1-r_0/r_1)+a]\end{aligned}$$

As can be seen from Table 1, the measurements for deriving the first aspect of the invention were carried out mainly on impellers whose blades are 0.5 mm thick. Thus, when the thickness "t" of the radially-directed blades is "$t_0$" ($t_0$=0.5 mm), the quietness of the multiblade radial fan is optimized provided the outlet breadth Δl of the interblade divergent channel satisfies $$\Delta l=(2\pi r_1/n)-t_0 \leqq \Delta l_c=-at_0/[(b-r_0/r_1)/(1-r_0/r_1)+a]$$

That is, $$(2\pi r_1/n)-t_0 \leqq -at_0/[(b-r_0/r_1)/(1-r_0/r_1)+a] \qquad \text{XI}$$

In the above formula, $t_0$=0.5 mm.

Now, the following assumption is introduced: even though the thickness "t" of the radially-directed blades is not equal to "$t_0$" ($t_0$=0.5 mm), the quietness of the multiblade radial fan is optimized if the outlet breadth Δl of the interblade divergent channel is smaller than the threshold value $\Delta l_c$ of the outlet breadth Δl of the interblade divergent channel where the thickness "t" of the radially-directed blades is equal to "$t_0$" ($t_0$ =0.5 mm).

Under the above assumption, the condition for optimizing the quietness of the multiblade radial fan is $$(2\pi r_1/n)-t \leqq -at_0/[(b-r_0/r_1)/(1-r_0/r_1)+a] \qquad \text{XII}$$

In the above formula, $t_0$=0.5 mm.

A formula XIII is derived from the formula XII.

$$(b-r_0/r_1)/(1-r_0/r_1) \leqq -a\{t_0/[(2\pi r_1/n)-t]+1\} \qquad \text{XIII}$$

Hereinafter, the right side of the formula XIII is called Karman-Millikan's second nondimensional number $Z_2$. Karman-Millikan's second nondimensional number $Z_2$ includes the number "n" and the thickness "t" of the radially-directed blades independently. Thus, Karman-Millikan's second nondimensional number $Z_2$ does not include the problem of Karman-Millikan's first nondimensional number $Z_1$.

The formula XIII is expressed as follows by using Karman-Millikan's second nondimensional number $Z_2$.

$$(b-r_0/r_1)/(1-r_0/r_1) \leqq Z_2 \qquad \text{XIV}$$

In the above formula, $Z_2=-a\{t_0/[(2\pi r_1/n)-t]+1\}$, a=−0.857, b=1.009, $t_0$ is the specific thickness of the radially-directed blades= 0.5 mm, $r_0$ is the inside radius of the impeller, $r_1$ is the outside radius of the impeller, n is the number of the radially-directed blades, and t is the thickness of the radially-directed blades.

Thus, if tests show that the quietness of a multiblade radial fan is optimized when Karman-Millikan's second nondimensional number $Z_2$ satisfies the formula XIV, a second aspect of the invention is established wherein the specifications of a multiblade radial fan are determined based on the formula XIV. The second aspect of the invention is more generalized than the first aspect of the invention wherein the specifications of a multiblade radial fan are determined based on the formula VII.

B. Performance Test of Multiblade Radial Fan.

Figure 9:
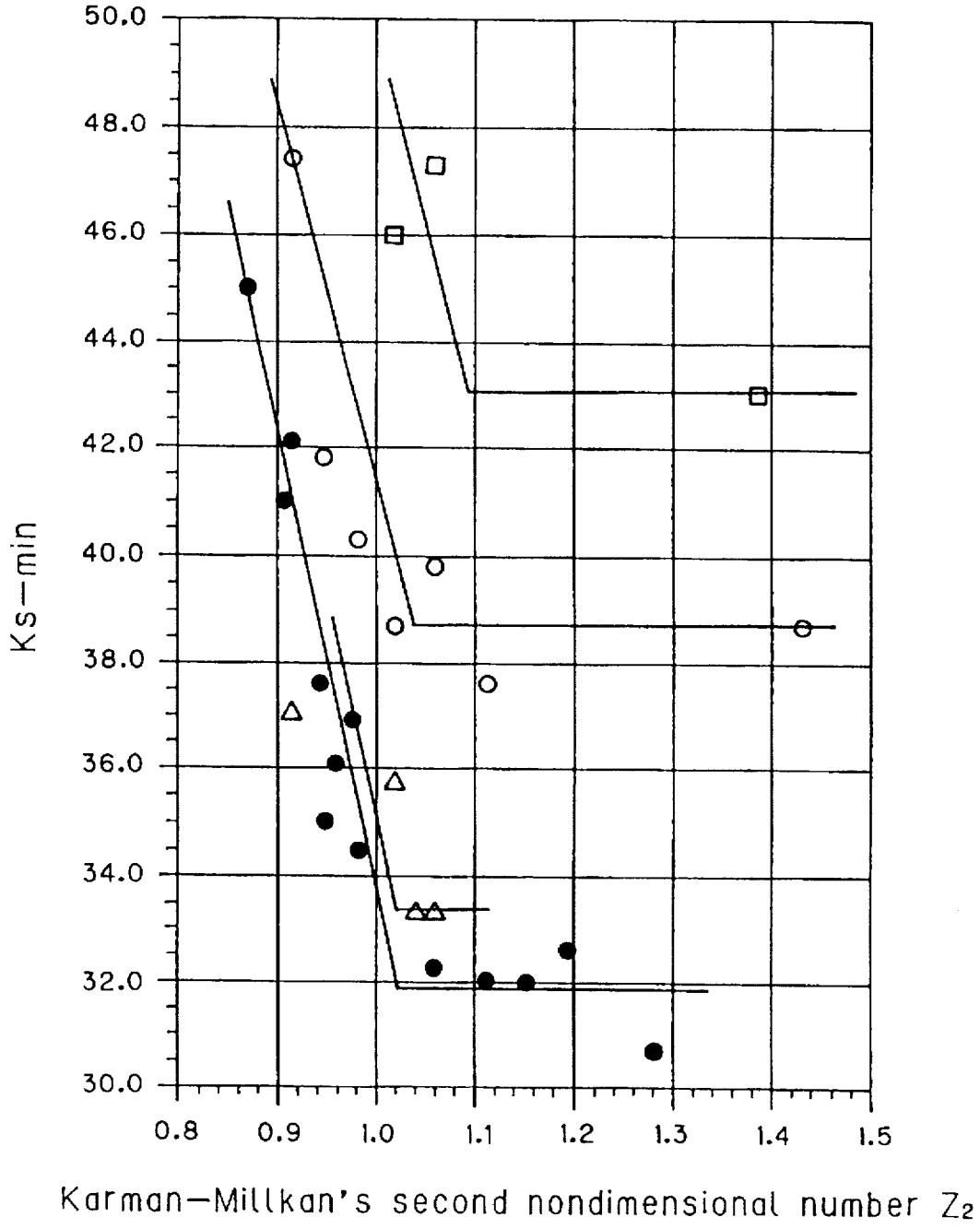
FIG. 9 shows experimentally-obtained correlation diagrams between minimum specific sound level $K_{smin}$ and second Karman-Millikan nondimensional number $Z_2$ of tested impellers.

Performance tests were carried out on multiblade radial fans with different values of the term $Z_2$ in the same way as described earlier in connection with the first aspect of the invention. The particulars, i.e., Karman-Millikan's first nondimensional number $Z_1$, Karman-Millikan's second nondimensional number $Z_2$, the minimum specific sound levels $K_{smin}$, and the rotation speeds of the tested impellers are listed in Table 2. The measured correlations between the minimum specific sound levels $K_{smin}$ and Karman-Millikan's second nondimensional number $Z_2$ of the tested impellers are shown in FIG. 9. A correlation diagram between the minimum specific sound level $K_{smin}$ and Karman-Millikan's second nondimensional number $Z_2$ was obtained for each group of impellers with the same diameter ratio. The correlation diagrams are also shown in FIG. 9.

As is clear from FIG. 9, for the same impeller diameter ratio, the minimum specific sound level $K_{smin}$ decreases as Karman-Millikan's second nondimensional number $Z_2$ increases. As is clear from the correlation diagrams in FIG. 9, in the impellers 1 with diameter ratios of 0.75, 0.58 and 0.4, the minimum specific sound levels $K_{smin}$ stay at constant minimum values when Karman-Millikan's second nondimensional number $Z_2$ exceeds certain threshold values. Though the threshold value of the impeller 1 with a diameter ratio of 0.90 is not clear owing to the small number of measured points, a correlation diagram of the impeller 1 with a diameter ratio of 0.90 having a threshold value estimated from those of the other correlation diagrams is also shown in FIG. 9.

Figure 10:
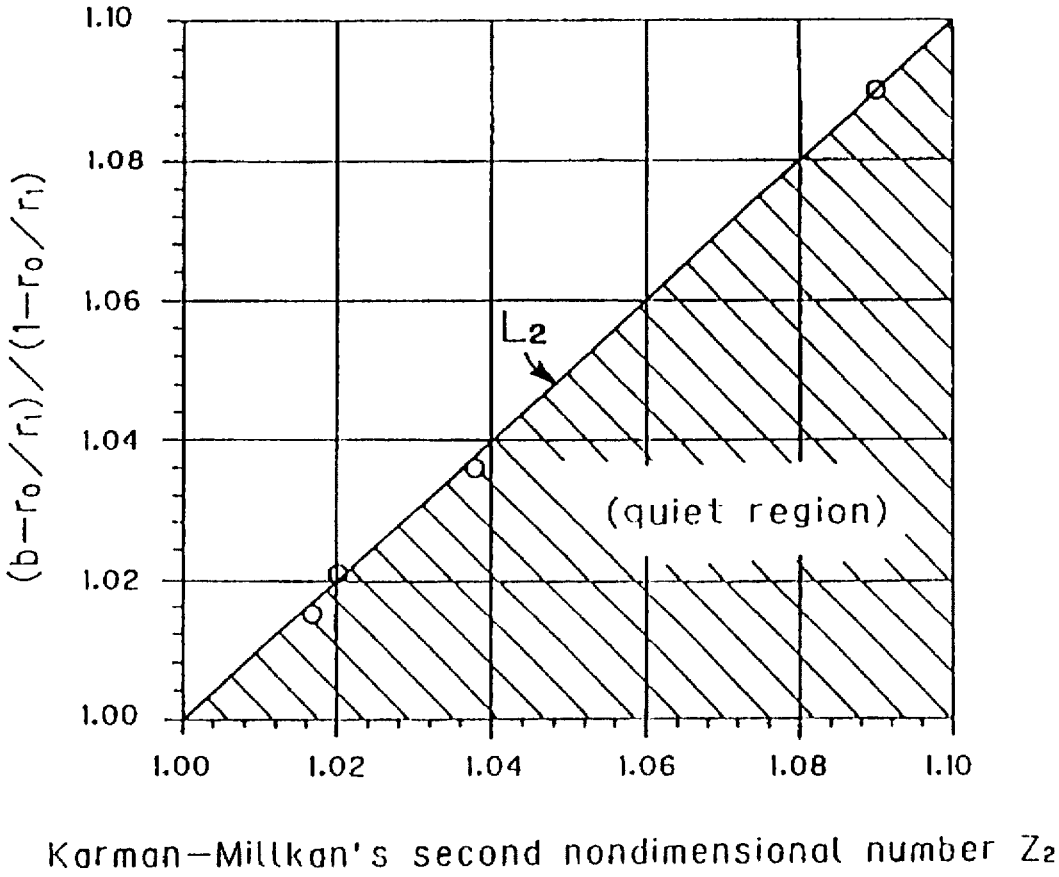
FIG. 10 is a correlation diagram between nondimensional number $(1.009-r_0/r_1)/(1-r_0/r_1)$ and a threshold level of second Karman-Millikan nondimensional number $Z_2$ of tested impellers.

The formula XIV is shown in FIG. 10. The hatched area on the right of the correlation diagram $L_2$ is the assumed quiet region.

Correlations between the nondimensional numbers $(b-r_0/r_1)/(1-r_0/r_1)$ derived from the specifications of the impellers and the threshold values of Karman-Millikan's second nondimensional number $Z_2$ were obtained from the correlation diagrams, shown in FIG. 9, between the minimum specific sound levels $K_{smin}$ and Karman-Millikan's second nondimensional number $Z_2$ of the groups of the impellers with diameter ratios of 0.75, 0.58 and 0.4. The correlations are shown in FIG. 10. As is clear from FIG. 10, the experimentally obtained correlations between the nondimensional numbers $(b-r_0/r_1)/(1-r_0/r_1)$ derived from the specifications of the impellers and the threshold values of Karman-Millikan's second nondimensional number $Z_2$ fall on the correlation diagram $L_2$. A correlation between the nondimensional number $(b-r_0/r_1)/(1-r_0/r_1)$ and the threshold value of Karman-Millikan's second nondimensional numbers $Z_2$ of the impeller with a diameter ratio of 0.90 was obtained from the correlation diagram shown in FIG. 9. This is also shown in FIG. 10. As is clear from FIG. 10, the correlation between the nondimensional number $(b-r_0/r_1)/(1-r_0/r_1)$ and the threshold value of Karman-Millikan's second nondimensional number $Z_2$ of the impeller with a diameter ratio of 0.90 also falls on the correlation diagram $L_2$.

Thus, it was experimentally confirmed that the quietness of a multiblade radial fan is optimized when Karman-Millikan's second nondimensional number $Z_2$ satisfies the formula XIV.

Thus, the quietness of a multiblade radial fan with a given impeller diameter ratio, can be optimized systematically, without resorting to trial and error, by determining the specifications of the impeller so that Karman-Millikan's second nondimensional number $Z_2$ falls in the hatched region in FIG. 10, or satisfies the correlation defined by formula XIV.

The formula XIV can be applied to impellers with diameter ratios in the range of from 0.40 to 0.90. As shown in FIG. 9, however, the minimum value of the minimum specific sound level $K_{smin}$ of the impeller with a diameter ratio of 0.90 is about 43 dB. In other words, an impeller with a diameter ratio of 0.90 cannot be made sufficiently quiet. It is therefore appropriate to apply the formula XIV to impellers with diameter ratios in the range of from 0.40 to 0.80.

Thus, a multiblade radial fan that achieves optimum and sufficient quietness under a given condition can be designed systematically, without resorting to trial and error, by applying the formula XIV to an impeller whose diameter ratio falls in the range from 0.40 to 0.80.

Figure 11:
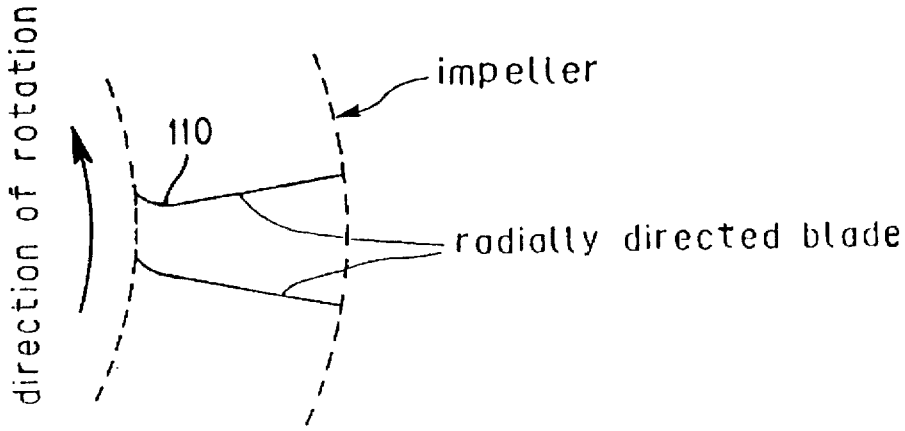
FIG. 11 is a plan sectional view of another type of radially-directed blade.
Figure 12A:
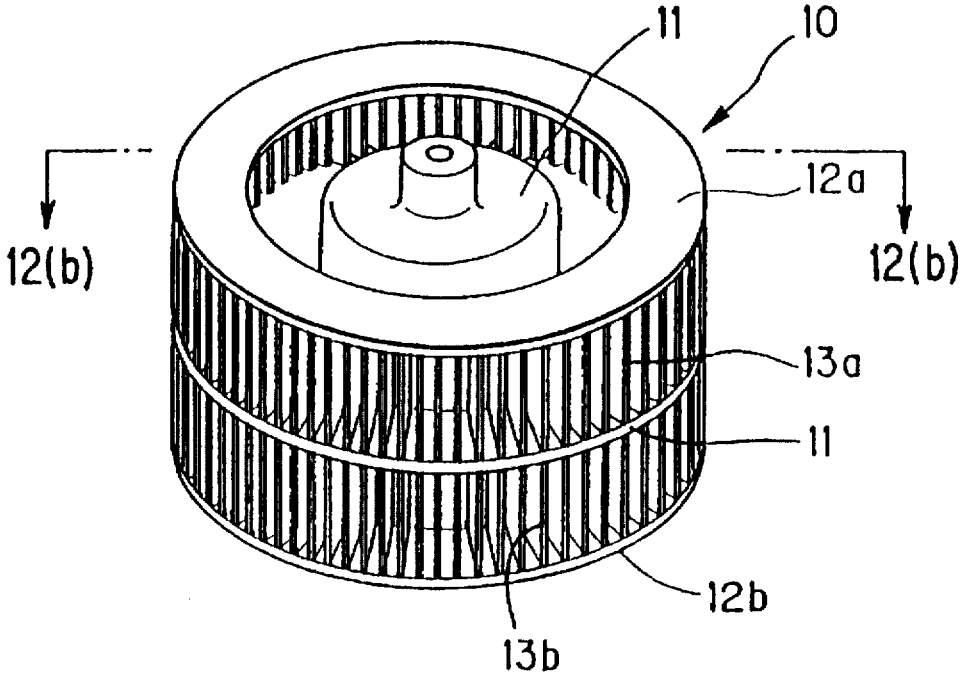
FIG. 12(*a*) is a perspective view of a double intake multiblade radial fan to which the present invention can be applied and FIG. 12(*b*) is a sectional view taken along line b—b in FIG. 12(*a*).
Figure 12B:
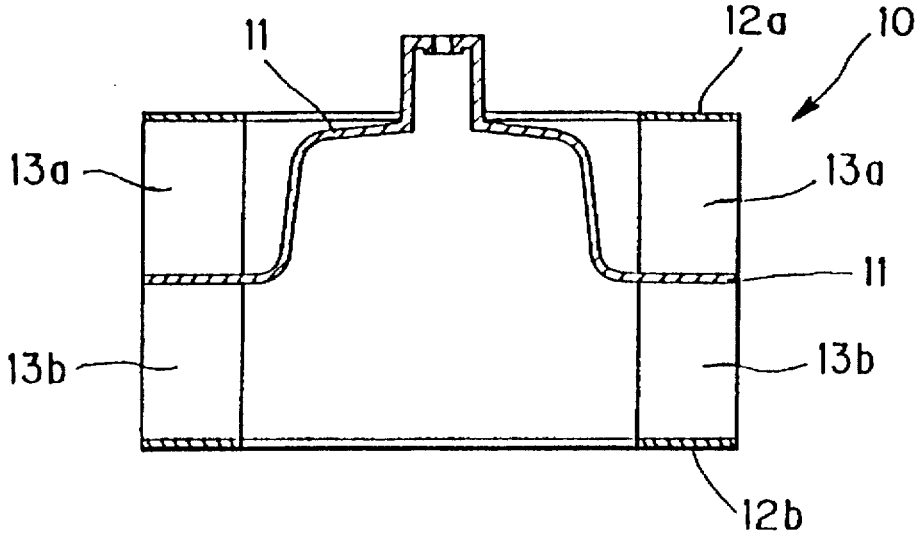

Radially-directed plate blades are used in the above embodiments. As shown in FIG. 11, the inner end portions 110 of the radially-directed plate blades can be bent in the direction of rotation of the impeller to decrease the inlet angle of the air flow against the radially-directed plate blades. This prevents the generation of turbulence in the air flow on the suction side of the inner end portion of the radially-directed plate blades and further enhances the quietness of the multiblade radial fan. The bend can be made on every blade, or at intervals of a predetermined number of blades.

The present invention can be applied to a double suction type multiblade radial fan such as the fan 10 shown in FIGS. 2(*a*) and 12(*b*). The double suction type multiblade radial fan 10 has a cup shaped circular base plate 11, a pair of annular plates 12*a*, 12*b* disposed on the opposite sides of the base plate 11, a large number of radially-directed plate blades 13*a* disposed between the base plate 11 and the annular plate 12*a*, and a large number of radially-directed plate blades 13*b* disposed between the base plate 11 and the annular plate 12*b*.

Multiblade radial fans in accordance with the present invention can be used in various kinds of apparatuses in which centrifugal fans such as sirocco fans and turbo fans, and cross flow fans, etc. have heretofore been used and, specifically, can be used in such apparatuses as hair driers, hot air type driers, air conditioners, air purifiers, office automation equipments, dehumidifiers, deodorization apparatuses, humidifiers, cleaning machines and atomizers.

According to the first aspect of the present invention, the specifications of the impeller of a multiblade radial fan are determined so as to satisfy the correlation expressed by the formula $v \geqq -0.857Z_1+1.009$ (in the preceding formula, $v=r_0/r_1$, $Z_1=(r_1-r_0)/[r_1-nt/(2\pi)]$, where $r_0$ is the inside radius of the impeller, $r_1$ is the outside radius of the impeller, n is the number of radially-directed blades, t is the thickness of the radially-directed blades), whereby the minimum specific sound level of the multiblade radial fan is minimized. Thus, in accordance with the first aspect of the present invention, a multiblade radial fan that achieves optimum quietness under a given condition can be designed systematically, without resorting to trial and error.

According to a modification of the first aspect of the present invention, specifications of the impeller of a multiblade radial fan are determined so as to satisfy the correlation expressed by the formulas $\nu \geqq -0.857Z_1+1.009$ and $0.8 \geqq \nu \geqq 0.4$ (in the preceding formulas, $\nu=r_0/r_1$, $Z_1=(r_1-r_0)/[r_1-nt/(2\pi)]$, where $r_0$ is the inside radius of the impeller, $r_1$ is the outside radius of the impeller, n is the number of radially-directed blades, t is the thickness of the radially-directed blades), whereby the minimum specific sound level of the multiblade radial fan is minimized. Thus, in accordance with the modification of the first aspect of the present invention, a multiblade radial fan that achieves optimum and sufficient quietness under a given condition and can be easily fabricated can be designed systematically, without resorting to trial and error.

According to the second aspect of the present invention, specifications of the impeller of a multiblade radial fan are determined so as to satisfy the correlation expressed by the formula $(1.009-\nu)/(1-\nu) \leqq Z_2$ (in the preceding formula, $\nu=r_0/r_1$, $Z_2=0.857\{t_0/[(2\pi r_1/n)-t]+1\}$, where $r_0$ is the inside radius of the impeller, $r_1$ is the outside radius of the impeller, is the number of radially-directed blades, t is the thickness of the radially-directed blades, and $t_0$ is the reference thickness=0.5 mm)), whereby the minimum specific sound level of the multiblade radial fan is minimized. Thus, in accordance with the second aspect of the present invention, a multiblade radial fan that achieves optimum quietness under a given condition can be designed systematically, without resorting to trial and error.

According to a modification of the second aspect of the present invention, there is provided a method for designing a multiblade radial fan, wherein specifications of the impeller of a multiblade radial fan, wherein specifications of the impeller of a multiblade radial fan are determined so as to satisfy the correlation expressed by the formulas $(1.009-\nu)/(1-\nu) \leqq Z_2$ and $0.8 \geqq \nu \geqq 0.4$ (in the preceding formulas, $\nu=r_0/r_1$, $Z_2=0.857\{t_0/[(2\pi r_1/n)-t]+1\}$, where $r_0$ is the inside radius of the impeller, $r_1$ is the outside radius of the impeller, n is the number of radially-directed blades, t is the thickness of the radially-directed blades, and $t_0$ is the reference thickness=0.5 mm)), whereby the minimum specific sound level of the multiblade radial fan is minimized. Thus, in accordance with the modification of the second aspect of the present invention, a multiblade radial fan that achieves optimum and sufficient quietness under a given condition and can be easily fabricated can be designed systematically, without resorting to trial and error.

The inner end portions of the radially-directed plate blades can be bent in the direction of rotation of the impeller to decrease the inlet angle of the air flow against the radially-directed plate blades. This prevents the generation of turbulence in the air flow on the suction side of the inner end portion of the radially-directed plate blades and further enhances the quietness of the multiblade radial fan. The bend can be made on every blade, or at intervals of a predetermined number of blades.

The present invention can be applied to a double suction type multiblade radial fan.

Multiblade radial fans in accordance with the present invention can be used in various kinds of apparatuses in which centrifugal fans such as sirocco fans, turbo fans, and cross flow fans, etc., have heretofore been used, specifically in such apparatuses as hair driers, hot air type driers, air conditioners, air purifiers, office automation equipments, dehumidifiers, deodorization apparatuses, humidifiers, cleaning machines and atomizers.

TABLE 1

| impeller NO. | outside diameter (mm) | inside diameter (mm) | thickness of radially directed blades (mm) | number of radially directed blades | $Z_1$ | $k_{S\,min}$ (dB) | revolution speed (rpm) |
|---|---|---|---|---|---|---|---|
| diameter ratio: 0.90 | | | | | | | |
| 1 | 100.0 | 90.0 | 0.5 | 100 | 0.1189 | 46.0 | 6000.0 |
| 2 | 100.0 | 90.0 | 0.5 | 120 | 0.1236 | 47.3 | 5000.0 |
| 3 | 100.0 | 90.0 | 0.5 | 240 | 0.1618 | 43.0 | 5000.0 |
| diameter ratio: 0.75 | | | | | | | |
| 4 | 100.0 | 75.0 | 0.5 | 40 | 0.2670 | 47.4 | 3000.0 |
| 5 | 100.0 | 75.0 | 0.5 | 60 | 0.2764 | 41.8 | 6000.0 |
| 6 | 100.0 | 75.0 | 0.5 | 80 | 0.2865 | 40.3 | 6000.0 |
| 7 | 100.0 | 75.0 | 0.5 | 100 | 0.2973 | 38.7 | 5000.0 |
| 8 | 100.0 | 75.0 | 0.5 | 120 | 0.3090 | 39.8 | 7200.0 |
| 9 | 100.0 | 75.0 | 0.5 | 144 | 0.3243 | 39.2 | 7200.0 |
| 10 | 100.0 | 75.0 | 0.3 | 300 | 0.3504 | 38.7 | 6000.0 |
| diameter ratio: 0.58 | | | | | | | |
| 11 | 100.0 | 58.0 | 0.5 | 10 | 0.4268 | 45.0 | 5000.0 |
| 12 | 100.0 | 58.0 | 0.5 | 40 | 0.4486 | 42.1 | 6000.0 |
| 13 | 100.0 | 58.0 | 0.5 | 60 | 0.4643 | 40.1 | 5000.0 |
| 14 | 100.0 | 58.0 | 0.5 | 80 | 0.4813 | 38.7 | 6000.0 |
| 15 | 100.0 | 58.0 | 0.5 | 100 | 0.4995 | 36.2 | 6000.0 |
| 16 | 100.0 | 58.0 | 0.5 | 120 | 0.5192 | 33.4 | 8000.0 |
| 17 | 100.0 | 58.0 | 0.3 | 144 | 0.4870 | 33.4 | 7200.0 |
| diameter ratio: 0.40 | | | | | | | |
| 18 | 100.0 | 40.0 | 0.5 | 40 | 0.6408 | 37.0 | 6000.0 |
| 19 | 100.0 | 40.0 | 0.5 | 100 | 0.7136 | 35.7 | 6000.0 |
| 20 | 100.0 | 40.0 | 0.3 | 120 | 0.6777 | 33.3 | 5000.0 |
| 21 | 100.0 | 40.0 | 0.5 | 120 | 0.7416 | 33.3 | 6000.0 |

TABLE 2

| impeller NO. | outside diameter (mm) | inside diameter (mm) | thickness of radially directed blades (mm) | number of radially directed blades | $Z_1$ | $Z_2$ | $k_{S\ min}$ (dB) | revolution speed (rpm) |
|---|---|---|---|---|---|---|---|---|
| diameter ratio: 0.90 | | | | | | | | |
| 1 | 100.0 | 90.0 | 0.5 | 100 | 0.119 | 1.019 | 46.0 | 6000.0 |
| 2 | 100.0 | 90.0 | 0.5 | 120 | 0.124 | 1.059 | 47.3 | 5000.0 |
| 3 | 100.0 | 90.0 | 0.5 | 240 | 0.162 | 1.387 | 43.0 | 5000.0 |
| diameter ratio: 0.75 | | | | | | | | |
| 4 | 100.0 | 75.0 | 0.5 | 40 | 0.267 | 0.915 | 47.4 | 3000.0 |
| 5 | 100.0 | 75.0 | 0.5 | 60 | 0.276 | 0.947 | 41.8 | 6000.0 |
| 6 | 100.0 | 75.0 | 0.5 | 80 | 0.286 | 0.982 | 40.3 | 6000.0 |
| 7 | 100.0 | 75.0 | 0.5 | 100 | 0.297 | 1.019 | 38.7 | 5000.0 |
| 8 | 100.0 | 75.0 | 0.5 | 120 | 0.309 | 1.059 | 39.8 | 7200.0 |
| 9 | 100.0 | 75.0 | 0.5 | 144 | 0.324 | 1.112 | 37.6 | 7200.0 |
| 10 | 100.0 | 75.0 | 0.3 | 300 | 0.350 | 1.430 | 38.7 | 6000.0 |
| diameter ratio: 0.58 | | | | | | | | |
| 11 | 100.0 | 58.0 | 0.5 | 10 | 0.427 | 0.871 | 45.0 | 5000.0 |
| 12 | 100.0 | 58.0 | 2.0 | 30 | 0.519 | 0.908 | 41.0 | 11200.0 |
| 13 | 100.0 | 58.0 | 0.5 | 40 | 0.449 | 0.915 | 42.1 | 6000.0 |
| 14 | 100.0 | 58.0 | 0.3 | 60 | 0.446 | 0.944 | 37.6 | 7000.0 |
| 15 | 100.0 | 58.0 | 0.5 | 60 | 0.464 | 0.947 | 35.0 | 5000.0 |
| 16 | 100.0 | 58.0 | 1.0 | 60 | 0.519 | 0.958 | 36.1 | 6000.0 |
| 17 | 100.0 | 58.0 | 0.3 | 80 | 0.455 | 0.975 | 36.9 | 7000.0 |
| 18 | 100.0 | 58.0 | 0.5 | 80 | 0.481 | 0.982 | 34.5 | 6000.0 |
| 19 | 100.0 | 58.0 | 0.3 | 200 | 0.519 | 1.194 | 32.6 | 6000.0 |
| 20 | 100.0 | 58.0 | 0.5 | 120 | 0.519 | 1.059 | 32.3 | 8000.0 |
| 21 | 100.0 | 58.0 | 0.3 | 240 | 0.545 | 1.282 | 30.7 | 7000.0 |
| 22 | 100.0 | 58.0 | 0.3 | 180 | 0.507 | 1.153 | 32.0 | 6000.0 |
| 23 | 100.0 | 58.0 | 0.5 | 144 | 0.545 | 1.112 | 32.0 | 6000.0 |
| diameter ratio: 0.40 | | | | | | | | |
| 24 | 100.0 | 40.0 | 0.5 | 40 | 0.641 | 0.915 | 37.0 | 6000.0 |
| 25 | 100.0 | 40.0 | 0.5 | 100 | 0.714 | 1.019 | 35.7 | 6000.0 |
| 26 | 100.0 | 40.0 | 0.3 | 120 | 0.678 | 1.042 | 33.3 | 5000.0 |
| 27 | 100.0 | 40.0 | 0.5 | 120 | 0.742 | 1.059 | 33.3 | 6000.0 |

We claim:

1. A multiblade radial fan comprising an impeller having an inside radius $r_0$ and an outside radius $r_1$, and a number n of radially-directed blades, each blade having a thickness t, wherein the impeller satisfies the formula:

$$v \geqq -0.857Z_1+1.009,$$

wherein $v=r_0/r_1$, and $Z_1=(r_1-r_0)/[r_1-nt/(2\pi)]$.

2. A multiblade radial fan according to claim 1, wherein each radially-directed blade has an inner end portion, and a plurality of the inner end potions are bent in a direction of rotation of the impeller.

3. A multiblade radial fan comprising an impeller having an inside radius $r_0$ and an outside radius $r_1$, and a number n of radially-directed blades, each blade having a thickness t, wherein the impeller satisfies the formulas:

$$v \geqq -0.857Z_1+1.009$$

and $$0.8 \geqq v \geqq 0.4,$$

wherein $v=r_0/r_1$, and $Z_1=(r_1-r_0)/[r_1-nt/(2\pi)]$.

4. A multiblade radial fan according to claim 3, wherein each radially-directed blade has an inner end portion, and a plurality of the inner end potions are bent in a direction of rotation of the impeller.

5. A multiblade radial fan comprising an impeller having an inside radius $r_0$ and an outside radius $r_1$, and a number n of radially-directed blades, each blade having a thickness t, wherein the fan satisfies the formula:

$$(1.009-v)/(1-v) \leqq Z_2,$$

wherein $v=r_0/r_1$, $Z_2=0.857\{t_0/[(2\pi r_1/n)-t]+1\}$, and $t_0$ is a reference thickness=0.5 mm).

6. A multiblade radial fan according to claim 5, wherein each radially-directed blade has an inner end portion, and a plurality of the inner end potions are bent in a direction of rotation of the impeller.

7. A multiblade radial fan comprising an impeller having an inside radius $r_0$ and an outside radius $r_1$, and a number n of radially-directed blades, each blade having a thickness t, wherein the impeller satisfies the formulas:

$$(1.009-v)/(1-v) \leqq Z_2$$

and $$0.8 \geqq v \geqq 0.4,$$

wherein $v=r_0/r_1$, $Z_2=0.857\{t_0/[(2\pi r_1/n)-t]+1\}$, and $t_0$ is a reference thickness=0.5 mm).

8. A multiblade radial fan according to claim 7, wherein each radially-directed blade has an inner end portion, and a plurality of the inner end potions are bent in a direction of rotation of the impeller.

9. A method for making a multiblade radial fan, comprising an impeller having an inside radius $r_0$ and an outside radius $r_1$, and a number n of radially-directed blades, each blade having a thickness t, the methods comprising the steps of:

specifying the impeller so as to satisfy a formula:

$$v \geqq -0.857Z_1+1.009,$$

wherein $v=r_0/r_1$, $Z_1=(r_1-r_0)/[r_1-nt/(2\pi)]$; and making a fan comprising the specified impeller.

10. A method for making a multiblade radial fan comprising an impeller having an inside radius $r_0$ and an outside radius $r_1$, and a number n of radially-directed blades, each blade having a thickness t, the method comprising the steps of;

specifying the impeller so as to satisfy the formulas:

$$v \geqq -0.857Z_1+1.009$$

and $$0.8 \geqq v \geqq 0.4,$$

wherein $v=r_0/r_1$, $Z_1=(r_1-r_0)/[r_1-nt/(2\pi)]$; and making a fan comprising the specified impeller.

11. A method for making a multiblade radial fan comprising an impeller having an inside radius $r_0$ and an outside radius $r_1$, and a number n of radially directed blades, each blade having a thickness t, the method comprising the steps of;

specifying the impeller so as to satisfy the formula:

$$(1.009-v)/(1-v) \leqq Z_2,$$

wherein $v=r_0/r_1$, $Z_2=0.857\{t_0/[(2\pi r_1/n)-t]+1\}$, and $t_0$ is a reference thickness=0.5 mm); and making a fan comprising the specified impeller.

12. A method for making a multiblade radial fan, comprising an impeller having an inside radius $r_0$ and an outside radius $r_1$, a number n of radially-directed blades, each blade having a thickness t, the method comprising the steps of;

specifying the impeller of multiblade radial so as to satisfy the formula:

$$(1.009-v)/(1-v) \leqq Z_2$$

and $$0.8 \geqq v \geqq 0.4,$$

wherein $v=r_0/r_1$, $Z_2=0.857\{t_0/[(2\pi r_1/n)-t]+1\}$, and $t_0$ is a reference thickness=0.5 mm); and making a fan comprising the specified impeller.

* * * * *